US005445520A

United States Patent [19]

Ichikawa

[11] Patent Number: 5,445,520

[45] Date of Patent: Aug. 29, 1995

[54] OIL LIGHTER

[75] Inventor: Makoto Ichikawa, Sakurashinmachi, Japan

[73] Assignee: Modern Royal Co., Ltd., Tokyo, Japan

[21] Appl. No.: 238,721

[22] Filed: May 5, 1994

[30] Foreign Application Priority Data

Oct. 26, 1993 [JP] Japan ..... 5-062091

[51] Int. Cl.[6] ..... F23D 3/18

[52] U.S. Cl. ..... 431/321; 431/277; 431/151

[58] Field of Search ..... 431/146, 152, 151, 276, 431/277

[56] References Cited

U.S. PATENT DOCUMENTS 2,529,094 11/1950 Miller ..... 431/152
2,559,497 7/1951 Fortin ..... 431/152
3,899,286 8/1975 Lockwood et al. ..... 431/152

FOREIGN PATENT DOCUMENTS 497496 12/1950 Belgium ..... 431/152

*Primary Examiner*—Carroll B. Dority
*Attorney, Agent, or Firm*—Oblon, Spivak, McClelland, Maier & Neustadt

[57] ABSTRACT

An oil lighter comprised of a lower primary chamber having an oil filler aperture, a secondary chamber that contains part of a wick that draws oil up, is located above the primary chamber and has a base aperture that communicates with the primary chamber, a valve to open and close the communicating aperture, comprised of a spindle supported in the secondary chamber so as to be vertically slidable and having at its lower end a shaft that passes through the communicating aperture between the primary and secondary chambers and protrudes into the primary chamber, said valve normally being urged downward to close the communicating aperture from above, and an operating means constituted by a lever for raising the spindle against the force that urges the spindle downward.

2 Claims, 5 Drawing Sheets 38
7
6
18
19
36
34
17
32
10
22
31
33
(13)14
28
16
37
35
5'
15
5
39
3

OIL LIGHTER

BACKGROUND OF THE INVENTION

1. Field of the Invention invention relates to an oil-fueled pocket lighter for lighting cigarettes and the like.

2. Description of the Invention

An oil lighter works by igniting oil drawn up by a wick partly immersed in oil. Thus, even when the lighter is not in use the oil continuously evaporates as it is drawn up by the wick, which can waste a considerable amount of oil.

To prevent this, U.S. Pat. No. 2,881,608 discloses an oil lighter arrangement in which the lighter is provided with a lower primary chamber with an oil filler aperture, an upper secondary chamber containing the oil-impregnated part of a wick, a valve for closing and opening communication between the primary and secondary chambers, and a device for operating the valve.* The valve between the chambers is normally kept closed to prevent the oil in the primary chamber from evaporating, and when the oil in the secondary chamber evaporates and the wick does not readily ignite, the lighter is turned upside down and the valve device is operated to open the valve to produce a flow of oil out of the primary chamber and into the secondary chamber.

In the above-described lighter the valve is provided horizontally between the two chambers, and to allow the oil in the secondary chamber to be replenished from the primary chamber, the valve is opened by pushing in one end of the valve piece that protrudes from the body of the lighter. However, it is difficult to push in the protruding end of the valve piece, and it is an operation that requires a fair amount of force to be exerted on the valve piece. The reason for this is that the valve is equipped with an O-ring that provides a tight seal to prevent oil leaking out onto the lighter via the valve, and so enough force has to be exerted on the protruding valve piece to enable it to be pushed in against the resistance of this tightly-fitting O-ring.

The primary chamber is normally sealed shut by a screw-plug in the filler aperture. This means that even when the lighter is turned upside down and the valve is opened, the oil does not flow smoothly into the secondary chamber from the sealed primary chamber. Because of this lack of a smooth flow, the valve piece has to be kept pressed in for an extended time to accomplish the required replenishment.

The object of the present invention is to provide an oil lighter in which the time required for the replenishment operation is reduced by effecting a smooth flow of oil from the primary chamber to the secondary chamber.

SUMMARY OF THE INVENTION

The above object is attained in accordance with the present invention by an oil lighter, comprising a lower primary chamber having an oil filler aperture, a secondary chamber that contains part of a wick that draws oil up, said secondary chamber being located above the primary chamber and having in its base portion an aperture that communicates with the primary chamber, a valve that opens and closes the communicating aperture and is comprised of a spindle supported in the secondary chamber so as to be vertically slidable and having at its lower end a shaft that passes through the communicating aperture between the primary and secondary chambers and protrudes into the primary chamber, said valve normally being urged downward to close the communicating aperture from above, and an operating means constituted by a lever for raising the spindle against the force that urges the spindle downward.

In accordance with this invention thus arranged a lever is used to move the spindle that opens and closes the communicating aperture between the primary and secondary chambers, the operation can be readily accomplished without requiring major force. Moreover, the opening of the communicating aperture in the base of the secondary chamber is formed into a conical recess which serves as a funnel facilitating the smooth flow of oil from the primary chamber to the secondary chamber.

Further features of the invention, its nature and various advantages will be more apparent from the accompanying drawings and following detailed description of the invention.

DESCRIPTION OF THE PREFERRED EMBODIMENT

Figure 1:
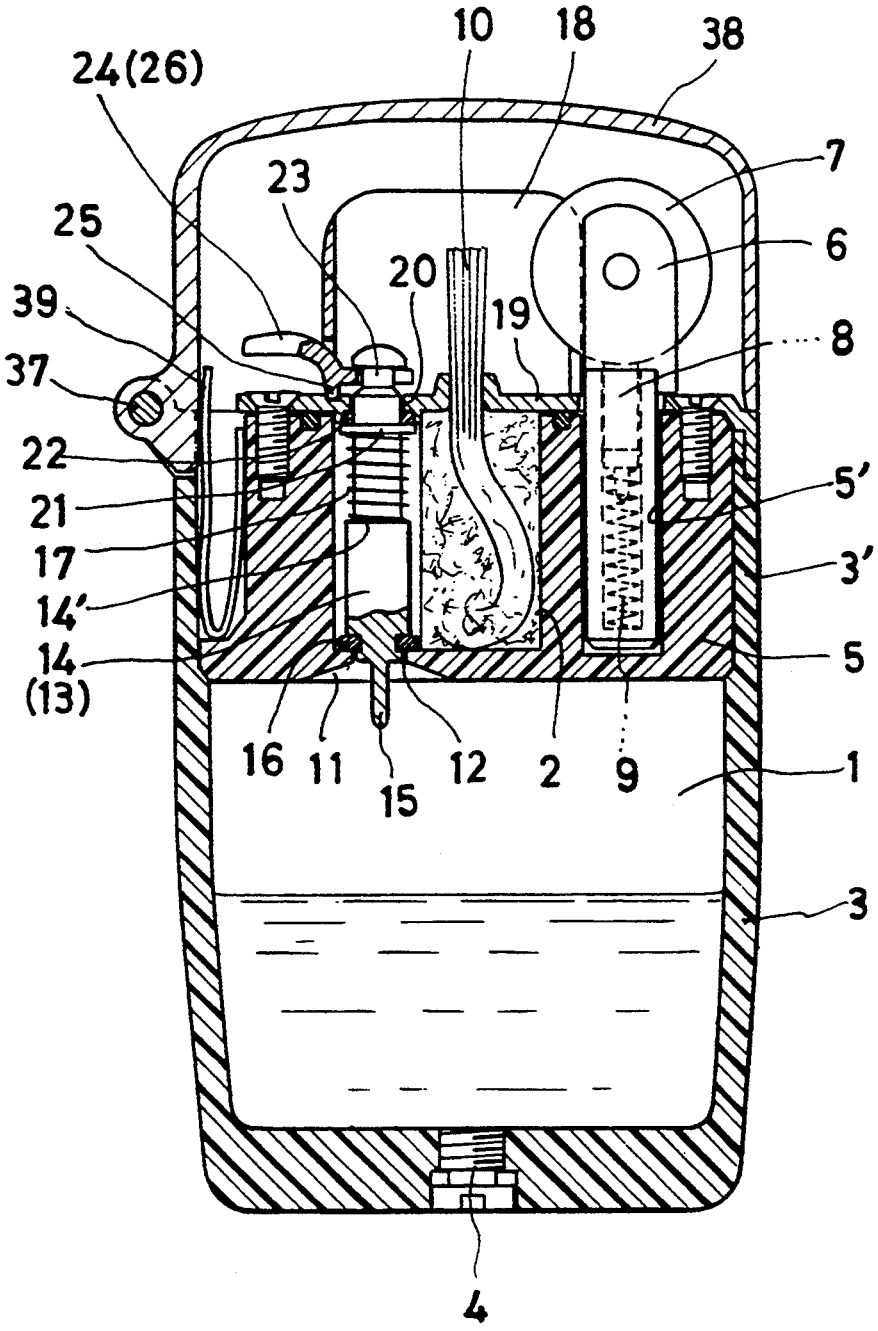
FIG. 1 is a cross-sectional drawing of an embodiment of the lighter according to the invention.
Figure 2:
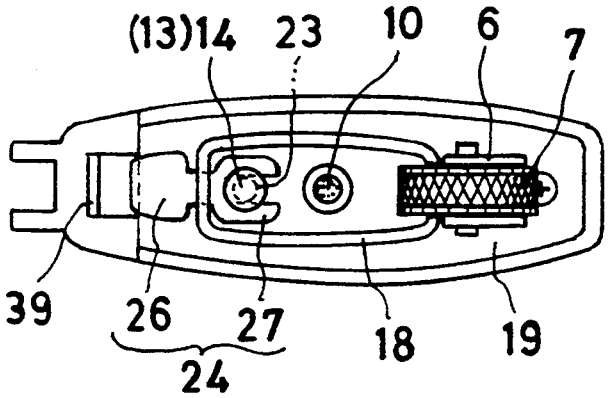
FIG. 2 is a plan view of the lighter with the cap removed.

The embodiments shown in the drawings each have a primary chamber 1 and a secondary chamber 2, the primary chamber 1 consisting of a clear plastic oil reservoir 3 that has an open top and a base with an oil charging inlet closed by a screw-plug 4.

The secondary chamber 2 is formed in a plastic main body 5 affixed above the primary chamber by bonding or the like. The tubular portion of a known support bracket 6 provided with a serrated wheel 7 that protrudes up past the upper surface thereof, an ignition flint 8 and a spring 9 which urges the flint up against the serrated wheel is held in a blind hole 5 in the main body 5 from which it can be removed upwardly. When the flint 8 is used up, it is replaced by removing the support bracket 6 from the hole 5', detaching the cylindrical portion of the bracket, inserting a new flint, and reassembling the parts.

The wick 10 extends upwards adjacent to the serrated wheel 7. By using a thumb to rotate the serrated wheel 7, sparks produced by the friction between the serrated wheel 7 and the flint 8 light the oil drawn up from the secondary chamber by the wick. Only a small part of the wick 10 protrudes, with the rest of the wick 10 filling the secondary chamber. The lower surface of the main body forming the base of the secondary chamber is provided with an upwardly-oriented conical recess 11. At the center of this recess is a communicating aperture 12 between the primary and secondary chambers.

The aperture 12 is closed and opened by a valve 13. The valve 13 is comprised of a spindle 14 that is vertically slidable within the secondary chamber and at its lower end has a shaft 15 that protrudes into the primary chamber via the communicating aperture 12 and recess 11. The spindle 14 is provided with a sealing ring 16 constituted by an O-ring, flat packing or the like around a decreased diameter portion above the shaft 15 and is urged downward by a coiled spring 17, urging the sealing ring 16 against the rim of the aperture 12 so that the aperture is normally closed.

In the embodiment shown in FIG. 1, the main body 5 is affixed inside an upward extension 3' of the reservoir 3. Also, a top plate 19 having a windshield 18 is screwed onto the top of the main body. As well as serving to close the secondary chamber, this top plate 19 maintains the wick 10 vertically upright by means of a hole formed in the top plate at the center of the windshield 18.

The upper end of the spindle 14 protrudes from a hole 20 formed in the top plate adjacent to the hole in which the wick 10 is supported. A coiled spring 17 provided around a reduced-diameter upper half of the spindle 14, with the lower end of the spring seated on a step 14'. A washer 21 and an O-ring 22 are arranged on the spindle above the coiled spring. Thus, the coiled spring 17 resiliently urges the spindle downward to cause the sealing ring 16 to press down onto rim of the aperture 12 and thereby close off the aperture, while at the same time the hole 20 is also sealed shut by the O-ring 22 being pressed, via the washer 21, up against the hole 20.

The upper end of the spindle protruding from the top plate is provided with a constricted neck portion 23, and a lever 24 projects into the windshield 18 via a cutaway portion and grips the neck portion 23 of the spindle. The lever 24 consists of a ridge 25 which acts as a fulcrum about a point of contact with the top plate 19, a thumbpiece 26 that extends beyond the windshield 18 so that it can be manually pressed downward, and an open bracket 27 that protrudes into the windshield 18 and holds neck portion 23. The tips of the arms of the bracket 27 are separated by slightly less than the diameter of the neck portion 23, but the inner parts of the arms are separated by slightly more than the neck diameter. This enables the neck portion to be readily clipped into place in the bracket to attach the lever to the spindle. Pressing down the thumbpiece 26 causes the spindle 14 to be raised against the resistance of the coiled spring 17, whereby the aperture 12 is opened by the sealing ring 16, which in the illustrated example is a flat packing.

Figure 4:
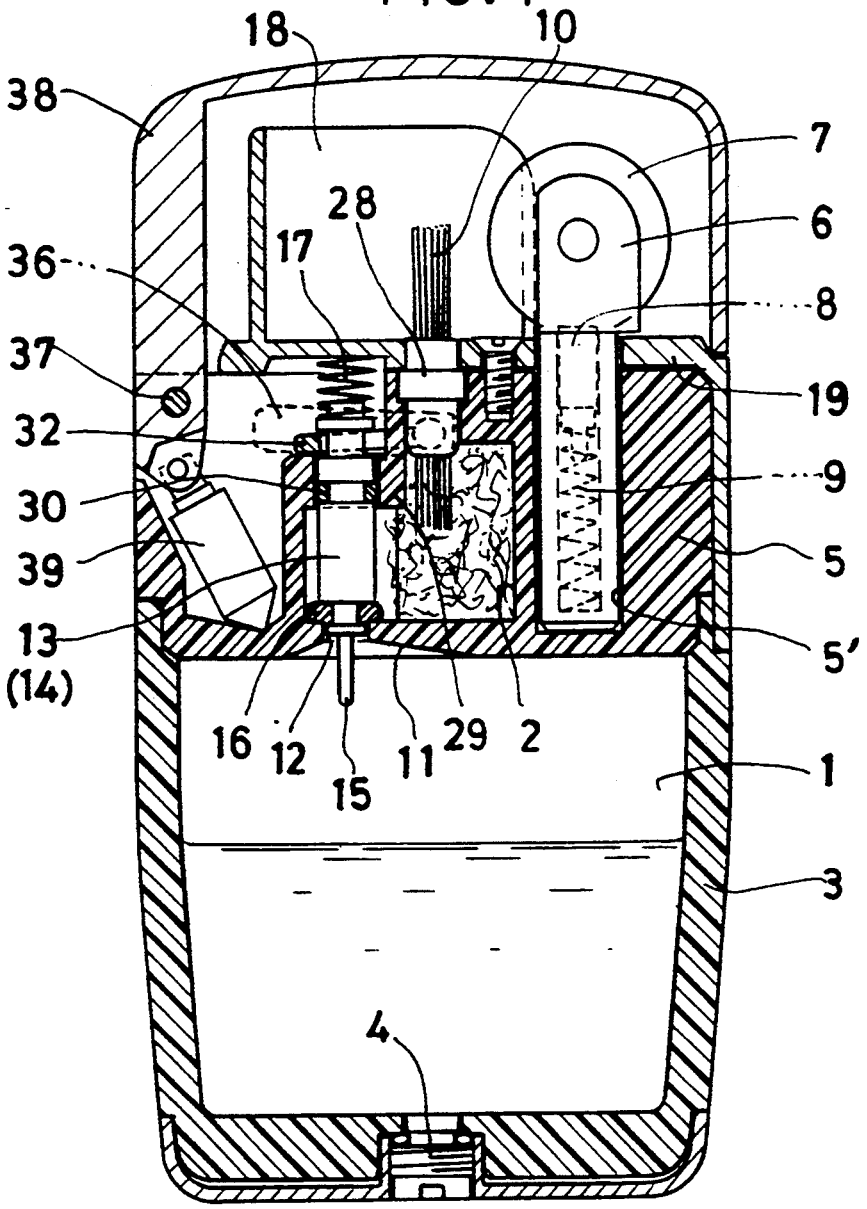
FIG. 4 is a cross-sectional drawing of another embodiment of the lighter of the invention.

In main body 5 of the embodiment shown in FIG. 4, the top wall of the secondary chamber is lower than the portion with the blind hole 5', and when the top plate 19 with the windshield 18 is attached by screws, a space is formed between the top plate 19 and the secondary chamber 2. A tubular piece 28 that holds the upper part of the wick 10 has upper and lower reduced diameter portions, with the upper reduced diameter portion affixed in a hole in the top plate 19 and the lower reduced diameter portion affixed in a hole in the top wall of the secondary chamber, thereby holding the upper end of the wick upright within the windshield 18.

The top wall of the secondary chamber has a short, downward-opening cylindrical portion 29 to guide the vertical movement of the valve spindle 14. Fitted on the upper portion of the spindle is an O-ring 30 in sliding contact with the inner surface of the downward-facing cylindrical portion, and the upper end that projects upward from the cylindrical portion is provided with a constricted neck portion 31, and the coiled spring 17 is compressed between the top plate 19 and the upper portion of the spindle.

The neck portion 31 is inserted into place in a divided lever 32. The lever 32 is comprised of one end 33 where the neck portion 31 is held, and two arms 34 that extend out from the end 33. The arms 34 extend at an upward angle so the ends thereof contact the top plate 19 on each side of a narrow portion 35 provided with the hole that holds the lower reduced diameter portion of the tubular piece 28 in the top wall of the secondary chamber, thereby forming a fulcrum. An operating arm 36 is affixed to one or both arm ends. Therefore, pulling up the arm 36 results in the end 33 being raised by the lever 32 with the arms 34 as the fulcrum, thereby lifting up the spindle 14 against the resistance of the coiled spring 17, opening the aperture 12.

Figure 3:
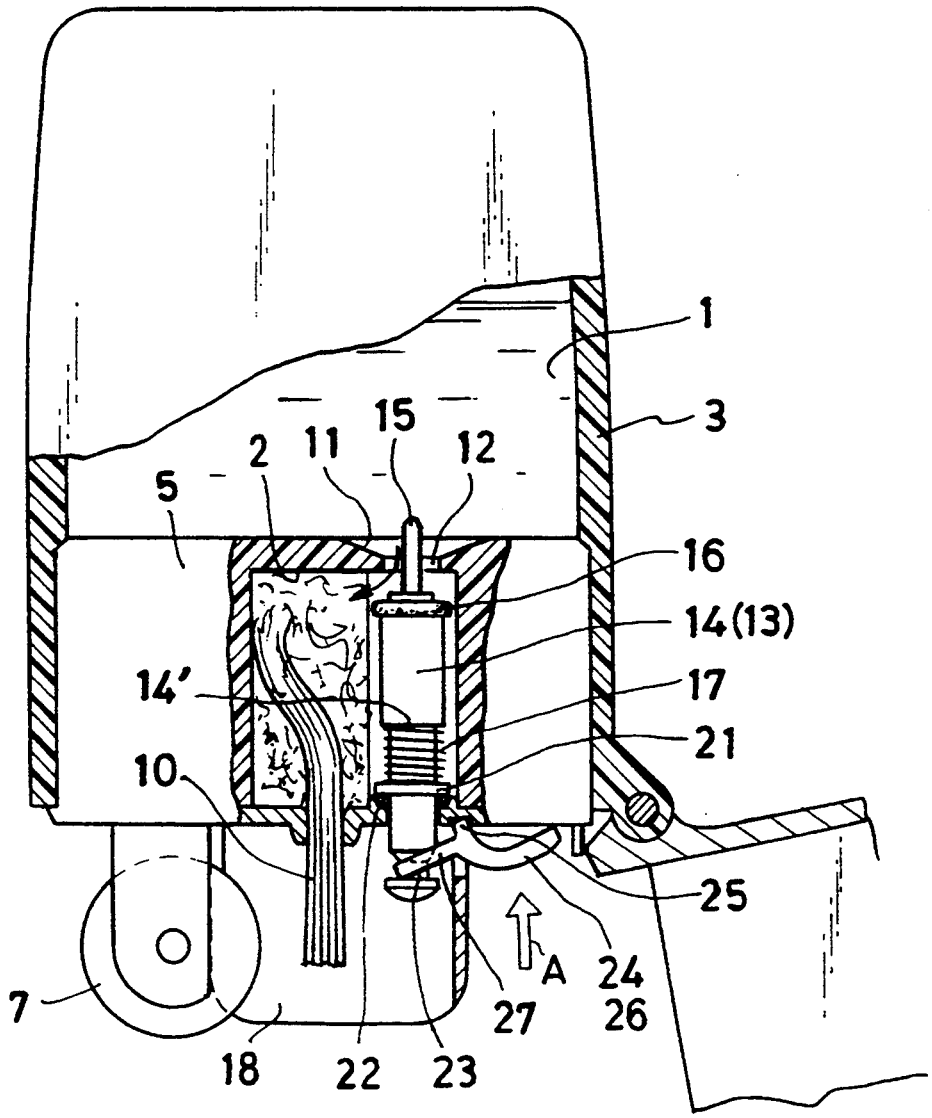
FIG. 3 illustrates the state in which the secondary chamber of the lighter is filled with oil.
Figure 7:
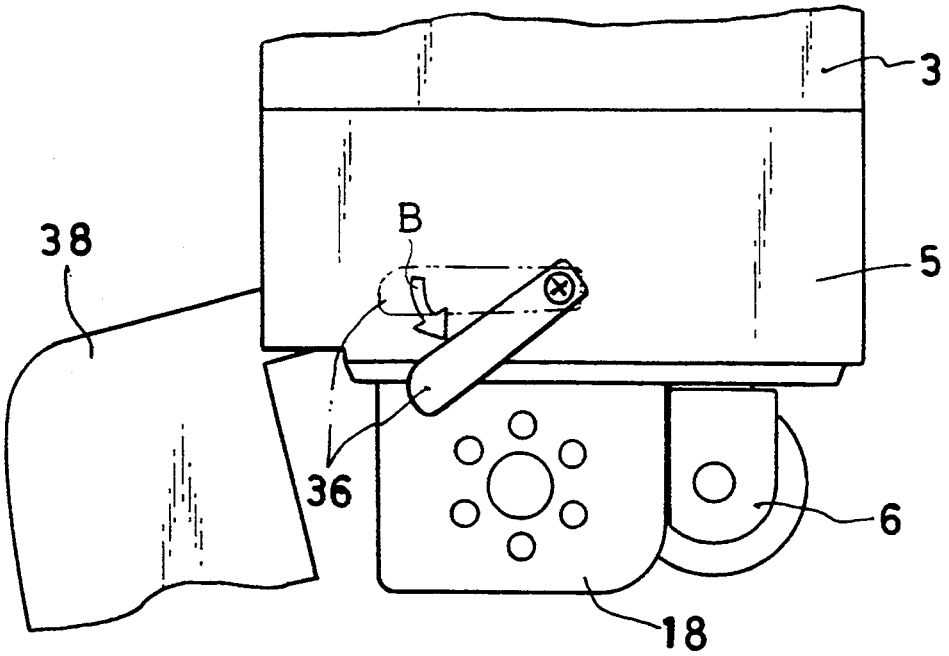
FIG. 7 illustrates how the arm is operated to fill the secondary chamber with oil.
Figure 8:
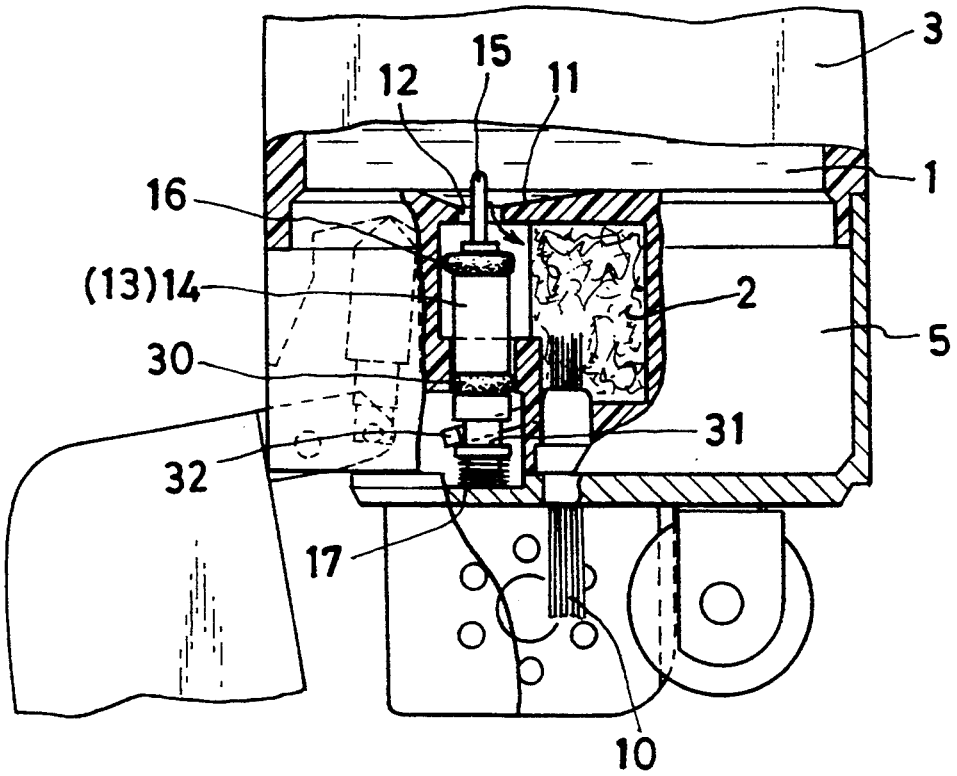
FIG. 8 illustrates the state in which the secondary chamber of the lighter of FIG. 4 is filled with oil.

If during use the wick fails to readily light, the lighter is turned upside down and, in the case of the embodiment of FIG. 1, the thumbpiece 26 of the lever 24 is pressed toward the top plate 19 in the direction indicated by arrow A in FIG. 3, while in the case of the embodiment shown in FIG. 4, the arm 36 is pulled downward in the direction indicated by in FIG. 7. This opens the aperture 12 by moving the spindle 14 against the force of the coiled spring 17, thereby reducing the depth of the insertion of the shaft 15 in the primary chamber 1 (see FIGS. 3 and 8). As the lighter is upside down, the oil in the sealed primary chamber will collect on the floor of the secondary chamber, filling the conical recess 11 and adhering to the shaft 15. A property of fluids is that they readily flow in a direction of adherence to a object, so that when the aperture 12 is opened the oil in the primary chamber sticking to the shaft 15 will readily flow along the shaft 15 into the secondary chamber, even though the primary chamber is sealed shut, thereby immersing the part of the wick in the secondary chamber.

Thus, opening the aperture 12 for a few seconds allows enough oil into the secondary chamber, and when the arm 36 is then released, the force of the coiled spring 17 causes the sealing ring 16 to close the aperture 12. A cap 38 on a pivot pin 37 is used to close the lighter when not in use. A spring-loaded means 39 is used to hold the cap in the required open and closed positions. The cap and the means 39 are known arrangements.

Figure 5:
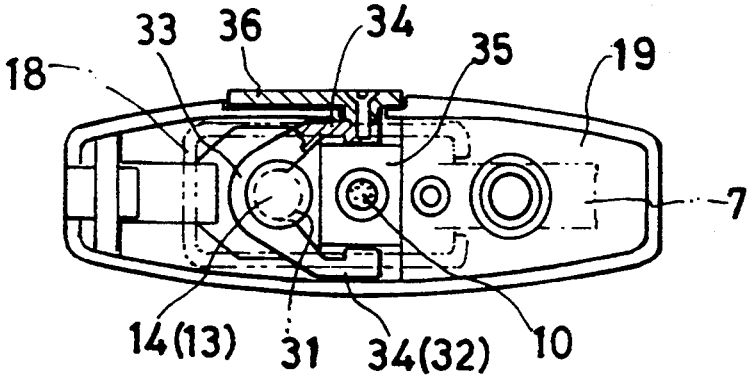
FIG. 5 is a plan view of the lighter with the cap removed.
Figure 6:
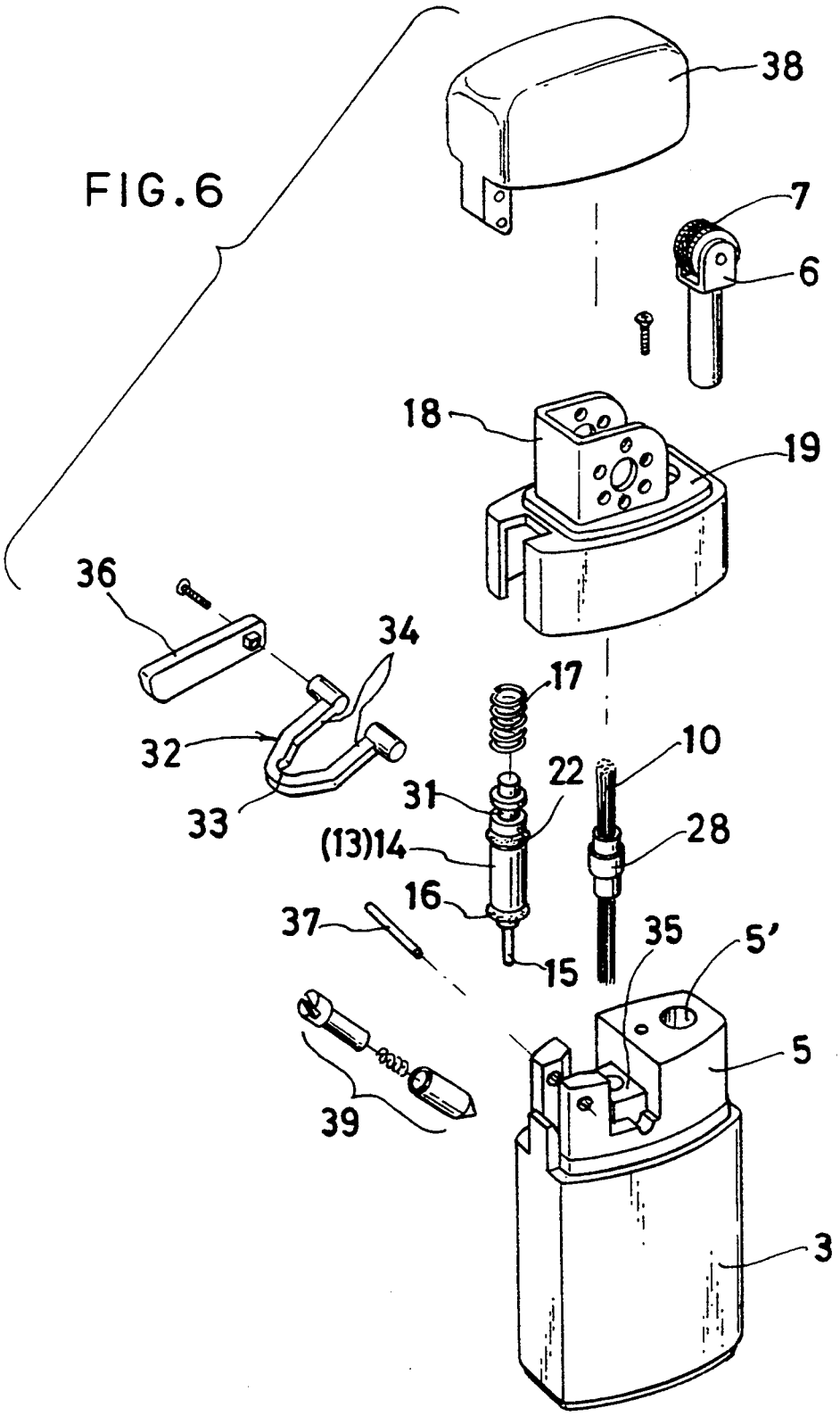
FIG. 6 is a perspective exploded view of the lighter.

As shown in the foregoing, a spindle 14 of a valve 13 that is used to close the communicating aperture 12 between primary and secondary chambers by a sealing ring 16 on the secondary chamber side is provided at its lower end with a shaft 15 that projects into the secondary chamber, and the base of the secondary chamber is provided with a conical recess 11. When the oil in the secondary chamber is to be replenished by oil in the primary chamber, the lighter is turned upside down and the aperture 12 opened by moving the spindle against the force of the coiled spring 17, and the oil flows from the primary chamber into the secondary chamber along the shaft 15. The spindle 14 is moved against the force of the coiled spring 17 either directly by a lever 24 (FIG. 1) or indirectly by a lever 32 and arm 36 (FIG. 5), and can therefore be readily accomplished without the need to exert much force. With this arrangement, replenishment of the oil in the secondary chamber takes only a very short time.

Japanese Utility ModelReg. Appln. No. 5-62091 filed Oct. 26, 1993 is hereby incorporated by reference.

What is claimed is:

1. An oil lighter comprising:

a primary chamber having an oil filler aperture in its lower portion;

a secondary chamber having an upper hole therein, and which contains part of a wick that draws oil up, said secondary chamber being located above the primary chamber and having in its base portion an aperture that communicates with the primary chamber;

a valve that opens and closes the communicating aperture and is comprised of a spindle supported in the secondary chamber so as to be vertically slidable and having at its lower end a shaft that passes through the communicating aperture between the primary and secondary chambers and protrudes into the primary chamber and at its upper end a neck portion that protrudes out of the secondary chamber through the upper hole thereof;

biasing means that normally urges the spindle downward and has at its upper end sealing means that normally seals the upper hole of the secondary chamber; and operating means constituted of a lever that has a fulcrum abutting against a portion of the secondary chamber in the vicinity of the upper hole and an open bracket holding the neck portion of the spindle for raising the spindle against the force of the biasing means.

2. The oil lighter according to claim 1, wherein the opening of the communicating aperture in the base of the secondary chamber is formed as a conical recess.

* * * * *